United States Patent [19]

Paspek, Jr. et al.

[11] Patent Number: 4,594,141

[45] Date of Patent: Jun. 10, 1986

[54] CONVERSION OF HIGH BOILING ORGANIC MATERIALS TO LOW BOILING MATERIALS

[75] Inventors: Stephen C. Paspek, Jr., North Royalton; Curtis D. Coker, Cleveland, both of Ohio

[73] Assignee: The Standard Oil Company, Cleveland, Ohio

[21] Appl. No.: 682,926

[22] Filed: Dec. 18, 1984

[51] Int. Cl.[4] ..... C10G 11/00; C10G 11/08

[52] U.S. Cl. ..... 208/390; 208/113; 208/115; 208/116; 208/420; 208/425; 208/433; 208/435; 208/952

[58] Field of Search ..... 208/115, 116, 108, 113, 208/8 LE, 11 LE

[56] References Cited

U.S. PATENT DOCUMENTS

| | | | |
|---|---|---|---|
| 2,417,105 | 3/1947 | Folkins | 208/115 |
| 2,527,573 | 10/1950 | Radford et al. | 208/115 |
| 2,694,035 | 11/1954 | Smith et al. | 208/115 |
| 3,113,844 | 10/1963 | Hemminger | 208/115 |
| 3,669,876 | 6/1972 | Berger | 208/115 |
| 3,764,515 | 10/1973 | Kiovsky | 208/108 |
| 3,847,795 | 11/1974 | Rieve et al. | 208/108 |
| 4,038,173 | 7/1977 | Myers | 208/112 |
| 4,363,717 | 12/1982 | Pelrine et al. | 208/116 |
| 4,483,761 | 11/1984 | Paspek, Jr. | 208/107 |
| 4,557,820 | 12/1985 | Paspek, Jr. et al. | 208/8 LE |

*Primary Examiner*—Andrew H. Metz
*Assistant Examiner*—Anthony McFarlane
*Attorney, Agent, or Firm*—Salvatore P. Pace; David J. Untener; Larry W. Evans

[57] ABSTRACT

A process for the conversion of high boiling saturated organic materials is described. The method comprises contacting said high boiling organic materials at a temperature of at least about 300° C. and at a reaction pressure of at least about 2000 psi with an aqueous acidic medium containing at least one olefin, and a halogen-containing compound selected from the group consisting of a halogen, a hydrogen halide, a compound which can form a halide or a hydrogen halide in the aqueous acidic medium under the process conditions, or mixtures thereof whereby the high boiling organic material and aqueous acidic medium form a substantially single phase system. Optionally the process can be conducted in a reducing atmosphere. The process of the invention is useful for producing and recovering fuel range liquids from petroleum, coal, oil shale, shale oil, tar sand solids, bitumen and heavy hydrocarbon oils such as crude oil distillation residues which contain little or no carbon-carbon unsaturation. Preferably, the halogen compound is at least one halogen or a hydrogen halide.

32 Claims, No Drawings

CONVERSION OF HIGH BOILING ORGANIC MATERIALS TO LOW BOILING MATERIALS

BACKGROUND OF THE INVENTION

The present invention relates to a process for the conversion of high boiling organic materials to lower boiling materials, and more particularly, to a method of recovering fuel range liquids from oil-containing compositions such as petroleum, coal, oil shale, shale oil, tar sand solids, bitumen and heavy hydrocarbon oil.

The potential reserves of liquid hydrocarbons which are contained in subterranean carbonaceous deposits have been identified as being substantial. Tar sands and oil shales represent two of the major potential resources of oil. In fact, the potential reserves of liquid hydrocarbons to be derived from tar sands and oil shales is believed to exceed the known reserves of liquid hydrocarbons to be derived from petroleum. However, the exploration of these potential reserves has been limited by the previously low priced and abundant supply of liquid crude oil and the process difficulties of extracting the heavier more viscous organic materials from tar sands and oil shales.

More recently, however, because of the ever increasing costs of liquid crude oils and the ever present threat of reduced availability from foreign sources, there is significant interest in improving the economics of recovering liquid hydrocarbons and in particular, fuel range liquids from tar sands and oil shale sources on a commercial scale. Methods have been suggested for recovering hydrocarbons from tar sands and oil shales, but the methods generally have not been accepted because of their high costs which renders recovered hydrocarbons too expensive to compete with petroleum crudes which can be recovered by more conventional methods.

The extraction of oil from tar sands and oil shales requires a physical separation process to break the oil/sand or shale bond. Techniques include the use of hot water, steam and/or hot gases. Such a process requires high temperatures.

The crude oil produced from both tar sands and oil shales requires further processing to convert it to an acceptable refinery feedstock. The tar sands crude is a heavy extremely viscous high sulfur crude generally requiring that it be coked and hydrogenated or alternatively, hydrocracked. The oil recovered from shale retorts is similar to conventional crudes in some respects and is extremely viscous and contains a high nitrogen content.

The value of the hydrocarbons which have been recovered from oil shale and tar sands also has been diminished due to the presence of certain contaminants such as suflur, nitrogen, and metallic compounds which have a negative effect on the catalyst utilized in many of the processes to which the recovered hydrocarbons may be subjected. The contaminants also are undesirable because of their disagreeable odor, corrosive characteristics and combustion products.

Petroleum oil fractions produced by atmospheric or vacuum distillation of crude petroleum also are characterized by relatively high concentrations of metals, sulfur and nitrogen. The high level of impurity results because substantially all of the contaminants present in the original crude remain in the residual fraction. The high metals content of the residual fractions generally preclude their effective use as charge stocks for subsequent catalytic processing because the metal contaminants deposit on the special catalyst for the processes and also result in the formation of inordinant amounts of coke, dry gas and hydrogen. For example, the delayed coking process has been effected on heavy residium fuels to obtain lower boiling cracked products. The process is considered a high severity thermal cracking process and yields larger amounts of coke by-product.

As mentioned above, many suggestions have been made in the prior art for recovering useful oil fractions from tar sands and shale oils as well as from various residual petroleum oil fractions derived from various sources. One such technique which has been suggested for recovering liquid hydrocarbons from tar sands and oil shale is called dense fluid extraction. The basic principals of dense fluid extraction at elevated temperatures are outlined in *The Principals of Gas Extraction,* by P. F. M. Paul and W. S. Wise, Mills and Boon Ltd., London, 1971. The dense liquid can be either a liquid or a dense gas having a liquid-like density. A number of prior art suggestions for recovering and upgrading hydrocarbons from oil shale and tar sands are discussed and summarized in U.S. Pat. Nos. 3,948,754 and 4,363,717 which are incorporated herein by reference.

Methods have been suggested for recovering liquid hydrocarbon fractions from various carbonaceous deposits utilizing water. U.S. Pat. No. 3,051,644 discloses a process for the recovery of oil from oil shale which involves subjecting the oil shale particles dispersed in steam to treatment with steam at temperatures in the range of from about 370° C. to about 485° C., and at a pressure in the range from about 1000 to 3000 psi. Oil from the oil shale is withdrawn in vapor form and admixed with steam. In U.S. Pat. No. 2,665,238, a process is described for recovering oil from oil shale which involves treating the shale with water in a large amount approaching the weight of the shale at a temperature in excess of 260° C. and under a pressure in excess of 1000 psi. The amount of oil recovered increses generally as the temperature or pressure is increased.

The prior art also has suggested processes for cracking, desulfurizing, denitrifying, demetallating and generally upgrading hydrocarbon fractions involving water. Examples of such prior art includes U.S. Pat. Nos. 3,453,206, 3,501,396, 3,586,621, 3,676,331 and 3,733,259. Many of the processes utilize various catalytic components such as metals deposited on a refractory inorganic oxide carrier, hydrogen, nickel spinel promoted with a barium salt of an organic acid in the presence of steam, carboxylic acid salts, etc.

U.S. Pat. No. 3,948,754 describes the process for recovering hydrocarbons from oil shale or tar sand solids and simultaneously for cracking, hydrogenating, desulfurizing, demetallating and denitrifying the recovered hydrocarbons. The process comprises contacting the oil shale or tar sand solids with a water-containing fluid at a temperature in the range of from about 315° to about 485° C. in the absence of externally supplied hydrogen and in the presence of an externally supplied catalyst system containing a sulfur- and nitrogen-resistant promoter. Such catalyst can be selected from the group consisting of at least one soluble or insoluble transition metal compound, a transition metal deposited on a support, and combinations thereof. Preferably, the catalyst system additionally contains a promoter such as at least one basic metal hydroxide, basic metal carbonate, transition metal oxide, oxide-forming transition metal salts or combinations thereof.

U.S. Pat. No. 4,363,717 describes the process for the convension of heavy hydrocarbon oils to motor fuel products. In particular, the heavy hydrocarbon oil is mixed with a metal halide catalyst and a solvent component under supercritical conditions to form (1) a dense-gas solvent phase which contains refined hydrocarbon crackate which is substantially free of metal halide catalyst content, and (2) a residual asphaltic phase. The phases are separated, and the dense-gas solvent extract phase is fractionated to remove the solvent and yield a refined hydrocarbon crackate fraction. The metal halides utilized are those metal chlorides, bromides and iodides which exhibit catalytic properties adapted for demetallation, desulfurization, denitrification and cracking of heavy hydrocarbon oil feedstocks under the process conditions. Examples of suitable metal catalysts include aluminum chloride, zinc chloride, gallium trichloride, cuprous chloride, cuprous bromide, etc.

The solvent which is present in the first step of the process described in U.S. Pat. No. 4,363,717 is indicated as being an important aspect of the invention. A solvent component preferably exhibits a dense-gas critical temperature limit in the range of between about 148°–370° C. Among the solvents mentioned are carbon dioxide, ammonia, water, methanol, ethane, hexane, benzene, dichlorodifluoro methane, nitrous oxide, diethylether, etc. Reference is made ot U.S. Pat. No. 4,108,760 for its extensive disclosure of organic gases and liquids suitable for application as supercritical fluids in dense-gas extraction techniques.

A procedure for the extraction of oil from shale and tar sands by supercritical water preferably containing dissolved salts is described in DE No. 3201719(A). Temperatures of from 360° C.–600° C. and pressures of 130–700 atmospheres are described as being used, and the water preferably contains one or more dissolved salts, especially, alkali, alkaline earth or ammonium chlorides or carbonates.

U.S. Pat. No. 4,483,761 describes a process for upgrading and cracking heavy hydrocarbons to lighter fuel range liquids. The process uses a water-containing medium and light olefins to improve the yield of liquid products and reduce the yield of gaseous products. The mixture of heavy hydrocarbons, olefin, and water-containing solvent is subjected to a temperature and pressure equal to or greater than the critical temperature and pressure of the water-containing solvent.

SUMMARY OF THE INVENTION

An improvement in the conversion of high boiling organic materials to low boiling materials, and more particularly, in the process of converting heavy hydrocarbon oil feedstocks to fuel range liquids is described. In its braodest aspects, the process comprises contacting said high boiling organic materials at a temperature of at least about 300° C. and at a reaction pressure of at least about 2000 psi with an aqueous acidic medium containing at least one olefin, and a halogen, a hydrogen halide, a compound which can form a halide or a hydrogen halide in the aqueous acidic medium under the process conditions, or mixtures thereof whereby the high boiling organic material, olefin, halogen compound and aqueous acidic medium form a substantially single phase system. Preferred halogen compounds are the halogens or the hydrogen halides, and preferred olefins are the 1-olefins. The process results in the recovery of fuel range liquids in high yields and containing reduced amounts of impurities such as metals, nitrogen and sulfur.

DESCRIPTION OF THE PREFERRED EMBODIMENTS

It now has been found that the process for forming and recovering low boiling materials from high boiling organic materials such as tar sands and oil shales, as well as petroleum and heavy hydrocarbon oil fractions utilizing high temperatures and pressures such as at supercritical conditions can be improved by utilizing aqueous acidic systems containing the combination of an olefin and a halogen, a hydrogen halide, compounds which can form a halide or a hydrogen halide in the aqueous acidic medium under the process conditions, or mixtures thereof. The process of this invention is particularly beneficial when the high boiling materials contain little or no material containing aliphatic carbon-to-carbon unsaturation.

In accordance with the present invention, high boiling organic materials are contacted with the above-described aqueous acidic medium at a temperature of at least about 300° C. and at a pressure of at least about 2000 psi forming a substantially single phase system for a period of time to provide the desired conversion of high boiling materials to lower boiling materials. When the mixture is allowed to attain non-supercritical conditions, (i.e., a lower temperature and/or pressure,) the reaction mixture forms an aqueous phase and an organic phase. The organic phase contains the desirable low boiling organic materials which can be recovered by known techniques. The recovered low boiling materials contain reduced amounts of impurities such as metals, nitrogen and sulfur. Optionally, the process can be conducted in a reducing atmosphere.

The high boiling organic materials which can be subjected to the process of the invention include, for example, petroleum, coal, oil shale, shale oil, tar sand solids, bitumen, and heavy hydrocarbon oils. Generally and preferably, the high boiling organic materials treated in accordance with the process of this invention will be substantially free of carbon-carbon unsaturation. More particularly, the process of the invention is especially beneficial when the high boiling organic materials contain less than about 10% of aliphatic carbon-carbon unsaturation.

The process of the present invention is useful particularly on residual petroleum oil fractions, shale oil, tar sand oil, bitumen, coal-derived hydrocarbons and other heavy hydrocarbon oils. All of these organic materials generally are characterized by relatively high metal, sulfur and nitrogen content. Principal metal contaminants include nickel, vanadium, iron and copper.

The conversion of high boiling organic materials to lower boiling organic materials effected by the process of the invention generally is referred to in the prior art as a cracking process, and this aspect of the process of the invention generally will be referred to hereinafter as cracking. More particularly, cracking is the chemical conversion of the hydrocarbons present in the organic materials into lighter, more useful hydrocarbon fractions such as fuel range liquids.

The olefins which are utilized in the process of the invention accelerate the cracking rate of saturated organic materials and increase the yield of lower boiling materials especially when used in combination with the promoters as hereinafter described. The type of olefin can vary although 1-olefins are preferred, and 1-olefins containing from 2 to 10 carbon atoms are especially useful. Examples of such olefins include ethylene, 1-propylene, 1-butylene, the various pentenes but particularly 1-pentene, 1-hexene, 1-octene and 1-decene. Substituted derivatives and isomers of such olefins also can be used. The olefins need not be pure olefins. They may constitute a fraction of a feedstock containing a wide range of organic and inorganic matter. It is possible to use ordinary refining streams such as coker-off-gas or retort off-gas without special preparation.

Olefin contents sufficient to provide a weight ratio of olefin to heavy hydrocarbon material of from about 0.001:1 to about 1:1 can be used. Generally the weight ratio will be from about 0.05:1 to about 0.1:1. Since the concentration of the carbon-carbon double bonds is an important factor, less ethylene is required than a higher molecular weight olefin such as 1-decene to produce the same effect. The upper limit on the concentration of olefin is determined by economics since an excess of olefin is not harmful. Excess olefin merely oligomerizes under the reaction conditions to produce additional distillate fuels.

As noted, the process of the present invention is conducted in an aqueous medium, and the mixture of high boiling organic materials, olefin, and aqueous medium containing the halogen compound as hereinafter described, is substantially a one-phase medium. This medium is not liquid or gaseous in the common meaning of these terms, but may be best described in terms of its density. Generally, the medium has a density of aobut 0.05 to about 1 gram per milliliter. More preferably, the medium has a density of about 0.1 to about 0.4 gram per milliliter. Most preferably, the medium has a density of about 0.2 to about 0.4 gram per milliliter.

In order to obtain the density required for the aqueous acidic medium, the medium must be at an elevated temperature and pressure. At room temperatures and atmospheric pressure, the high boiling organic materials and water are not fully miscible. However, the high boiling organic materials are readily miscible in an aqueous acidic medium at elevated temperatures and pressures, especially those near the critical temperature and pressure of water. Accordingly, temperatures and pressures approaching or greater than the critical temperature and pressure for water are most suitable for this process. Generally, the cracking reaction is conducted at a temperature of at least about 300° C. and at a pressure of at least about 2000 psi.

The aqueous acidic medium utilized in the process of the present invention comprises water and a small amount of additive material which either is itself acidic or will generate an acidic material under the conditions of the process. It is essential that the aqueous medium be acidic, that is, the aqueous medium must have a pH of less than 7 at least initially, i.e., at the beginning of the cracking process. The medium may not be and does not have to be acidic throughout the cracking process. Generally, the aqueous medium will be rendered initially acidic in mature by the addition of the halogen-containing compounds which are described more fully hereinafter. The optimum pH will depend on a variety of factors including the nature and characteristics of the heavy hydrocarbon oils being treated. If the hydrocarbon is basic, additional acid may be required. Also with certain of the halogen producing materials including halogen-containing organic compounds, some acid may have to be added to the aqueous medium to provide the desired results. This can be readily determined by one skilled in the art. Other ingredients in the medium may include promoters, light hydrocarbons, alcohols, etc.

The amount of aqueous medium utilized in the process of the invention generally will be related to the amount of high boiling organic material being subjected to the process of the invention. In one embodiment, the weight ratio of water to organic materials in the process will be in the range of from about 0.1:1 to about 50:1, and more generally, in the range of from about 0.5:1 to about 5:1. In the preferred embodiment, the weight ratio of water to organic material is from about 1:1 to 3:1.

The aqueous acidic medium utilized in the process of the present invention contains a halogen-containing compound selected from the group consisting of a halogen, a hydrogen halide, a compound which can form a halide or a hydrogen halide in the aqueous acidic medium under the process conditions, or mixtures thereof. Any of the halogens can be utilized in the process including chlorine, bromine, iodine and fluorine with a preference for chlorine and bromine. Among the hydrogen halides which can be utilized are hydrogen chloride, hydrogen bromide, hydrogen iodide, hydrogen fluoride. The presently preferred hydrogen halides are hydrogen chloride and hydrogen bromide.

Compounds which can form halides or hydrogen halides in the aqueous acidic medium under the process conditions also can be utilized in the process of the invention. Organic as well as inorganic materials are contemplated as being useful. Such halogen-containing compounds are useful because of their instability in water, particularly, under the conditions of the process. Among the organic materials useful in the process of the present invention are halogen-containing organic compounds such as chloroform, carbon tetrachloride, dichlorethane, methylene chloride and chlorobenzene.

Also useful as compounds which can form halides and hydrogen halides under the process conditions are metal halides other than those of the Group IA and Group IIA metals. Suitable examples include nickle chloride, aluminum trichloride, gallium trichloride, zirconium tetrachloride, titanium tetrabromide, and other transition metal halides. The transition metal halides preferably are selected from the group consisting of the transition metals of Group IVB, VB, VIB and VIIB of the periodic chart.

The amount of halogen compound included in the aqueous acidic media used in the process of the invention can vary over a wide range such as from about 0.1 to about 50% by weight based on the weight of the high boiling organic material. However, the use of the larger amounts generally is not required or desirable in view of the added costs of using large amounts. More generally, halogen compound to hydrocarbon weight ratios of from about 0.01 to about 0.2 provide desirable results.

The process of this invention can be conducted in a reducing atmosphere. Any readily available reducing gas can be used. The reducing gas may be pure hydrogen; pure carbon monoxide, or a mixture of these gases. Alternatively the reducing gas may be mixed with one or more other gases or vapors which are relatively inert to the process. Such inert gases include nitrogen, carbon dioxide, etc. A convenient and useful source of reducing gas are the synthesis gases produced by reaction of carbon or hydrocarbons with steam to produce carbon monoxide and hydrogen. A variety of methods for producing such synthesis gases is known in the art.

The process of the invention can be conducted either as a batch or continuous process. In a preferred embodiment, the weight ratio of aqueous acidic medium to high boiling organic material is typically from about 1:1 to 3:1, and the olefin to hydrocarbon ratio is varied as from about 0.01:1 to about 0.2:1. The reaction temperatures preferably are in the range of from about 400° to 450° C., reaction pressures are in the range of about 4000 to 5000 psi, and the reaction times are normally about 5 to 120 minutes.

When a batch process is utilized, the high boiling organic material such as shale oil, water olefin and halogen-containing compounds are added to a reaction vessel such as an autoclave. The autoclave then is sealed and heated to the desired operating temperature and pressure, and when the operating temperature and pressure are reached, they are maintained for the alloted period of time to effect the desired cracking of the high boiling organic materials. Generally, a period of from about one minute to about 6 hours is adequate to provide the desired degree of conversion of high boiling materials to lower boiling materials. The reactor then is cooled, for example, to room temperature whereupon the reaction mixture separates into an aqueous phase and an oil phase. The oil phase is separated from the aqueous phase and subjected to various techniques to isolate and recover the desired low boiling fractions such as by distillation or by chromatographic techniques.

When a continuous process is utilized, the reaction product obtained from the autoclave is allowed to separate into two phases and the oil phase is recovered. The aqueous phase, as well as any residue recovered from the oil phase can be recycled to the autoclave where the recycled organic material is, in effect, subject to a second cracking, in further conversion and recovery of desirable low boiling materials.

The process of the present invention has several advantages over the previously described prior art processes particularly when the high boiling materials to be cracked contain little or no carbon-carbon unsaturation. The process of the invention produces desirable low boiling products and increased yields under relatively mild conditions. Moreover, the products obtained by the process of the invention contain reduced amounts of undesirable metals, nitrogen and sulfur, and in particular, reduced amounts of nitrogen. Also, the amount of coke produced inside the reactor as the result of the process of the invention is reduced. The reduction of coke formation as compared to the delayed coking process is a significant benefit since coke tends to foul conventional reactors, and where coke is produced, the reactors must be shut down regularly and cleaned. The reduction in the amount of coke formed means that these reactors are capable of being operated continuously for longer periods.

The following examples, except those identified as controls, illustrate the process of the invention. Unless otherwise indicated, all parts and percentages are by weight, temperatures are in degrees centigrade, and times are in minutes. Distillate and residual yields are reported as volume percent.

The experiments described below are conducted batch-wise in a 300 cc. stirred autoclave. The water/hydrocarbon ratio is typically 2, and the olefin/hydrocarbon and halogen compound hydrocarbon ratios are varied as indicated. Reaction temperatures are 425° C., reaction pressures typically are from 4000–5000 psi, and the reaction time is one hour. At the end of the reaction, the reaction mixture is allowed to cool to about room temperature whereupon the gas present in the reactor is removed by bleeding through the top of the reactor into a gas sample bomb which is then sealed. The weight of the gas is determined. The autoclave is pressured with helium to force the liquid products contained therein through a dip tube into a centrifuge tube which is immediately capped. The autoclave then is opened and the residual liquid product (generally less than 1 cc.) is removed with a syringe. This liquid is added to the material in the sealed centrifuge tube.

The oil-water mixture in the centrifuge tube is centrifuged at about 2500 G. for a period of about 15 to 20 minutes and the full centrifuge tube is weighed. The oil phase is drawn off and placed in a sealed bottle and subsequently is analyzed by gas chromatography. Generally, small amounts of coke are observed in the autoclave at the end of the reaction, and this coke is removed prior to reusing the autoclave.

The results of a series of experiments conducted on hexadecane as the high boiling organic material and utilizing ethylene as the olefin and hydrogen chloride the halogen-containing compounds are summarized in the following Table I.

TABLE I

| Example | Ethylene/HC (wt/wt) | HCl/HC (wt/wt) | Cracked Product Yld. (Vol. %) |
|---|---|---|---|
| Control 1 | 0 | 0 | 26 |
| Control 2 | 0 | 0.07 | 21 |
| Control 3 | 0.3 | 0 | 41 |
| Invention | 0.3 | 0.1 | 56 |

The results summarized in Table I demonstrate the improvement which is obtained when an olefin and a hydrogen halide are included in the process of the invention.

Although only a few embodiments of this invention have been described above, it should be appreciated that many additions and modifications can be made without departing from the spirit and scope of the invention. These and all other modifications are intended to be included within the scope of this invention which is to be limited only by the following claims.

We claim:

1. A process for the conversion of high boiling organic materials to lower boiling materials comprising contacting said high boiling organic materials at a temperature of at least about 300° C. and at a reaction pressure of at least about 2000 psi with an aqueous acidic medium containing at least one olefin, and a compound selected from the group consisting of a halogen, a hydrogen halide, a halogen-containing organic compound or metal halide other than those of Group IA and Group IIA metals which can form a halide or a hydrogen halide in the aqueous acidic medium under the process conditions, or mixtures thereof whereby the high boiling organic material and aqueous acidic medium form a substantially single phase system.

2. The process of claim 1 wherein the olefin is at least one 1-olefin.

3. The process of claim 2 wherein the olefin contains from about 2 to 10 carbon atoms.

4. The process of claim 1 wherein the compound is a halogen or a hydrogen halide.

5. The process of claim 1 wherein the compound which can form a halide or a hydrogen halide is a transition metal halide.

6. The process of claim 1 wherein the compound which can form a halide or a hydrogen halide is a halogen-containing organic compound.

7. The process of claim 1 wherein the high boiling organic material is petroleum, coal, oil shale, shale oil, tar sand solids, bitumen, or a heavy hydrocarbon oil.

8. The process of claim 7 wherein the high boiling material is substantially free of carbon-carbon unsaturation.

9. The process of claim 4 wherein the halogen is chlorine or bromine.

10. The process of claim 4 wherein the hydrogen halide is hydrogen chloride or hydrogen bromide.

11. The process of claim 1 wherein the temperature is in the range of about 300° to about 1000° C.

12. The process of claim 1 wherein the weight ratio of water to high boiling saturated organic materials used in the process is in the range of from about 0.1:1 to about 50:1.

13. The process of claim 1 wherein the weight ratio of olefin to organic material is from about 0.001:1 to about 1:1.

14. The process of claim 1 wherein the weight ratio of compound to organic material is from about 0.001:1 to about 0.5:1.

15. The process of claim 1 wherein said process is conducted in a reducing atmosphere.

16. The process of claim 15 wherein the reducing atmosphere contains hydrogen.

17. The process for recovering lower boiling liquids from heavy hydrocarbon oil feedstocks which comprises the steps of (a) contacting the heavy hydrocarbon oil feedstock at a temperature at least about 375° C. and at a pressure of at least about 2000 psi with an aqueous acidic medium containing at least one 1-olefin and a compound selected from the group consisting of a halogen, a hydrogen halide, a halogen-containing organic compound or metal halide other than those of Group IA and Group IIA metals which can form a halide or a hydrogen halide in the aqueous acidic medium under the process conditions, or mixtures thereof whereby the heavy hydrocarbon oil stocks and aqueous acidic medium form a substantially single phase system for a period of time sufficient to provide a conversion of oil feedstock to lower boiling liquids, (b) lowering the temperature, pressure, or both, of the mixture to form an aqueous phase and an organic phase, and (c) separating the organic phase from the aqueous phase and recovering the lower boiling liquids from the organic phase.

18. The process of claim 17 wherein the compound is a halogen.

19. The process of claim 18 wherein the halogen is chlorine or bromine.

20. The process of claim 17 wherein the olefin contains from 2 to about 10 carbon atoms.

21. The process of claim 17 wherein the compound is a hydrogen halide.

22. The process of claim 17 wherein step (a) is conducted in a reducing atmosphere.

23. The process of claim 22 wherein the reducing atmosphere contains hydrogen.

24. The process of claim 17 wherein the hydrocarbon oil feedstock is in contact with the aqueous acidic medium in step (a) for a period of from about 1 minute to about 6 hours.

25. The process of claim 17 wherein the heavy hydrocarbon oil feedstock is substantially free of carbon-carbon unsaturation.

26. A process for converting heavy hydrocarbon oil feedstocks to lower boiling liquids which comprises the steps of (a) contacting said oil feedstocks with an aqueous acidic medium containing at least one 1-olefin and a halogen, a hydrogen halide, or mixtures thereof at a temperature in excess of 375° C. and at a pressure of at least about 2000 psi whereby the temperature and pressure are sufficient to maintain the mixture of hydrocarbon oil feedstock and aqueous acidic medium in a substantially single-phase system for a period of time sufficient to provide the conversion of the feedstock to lower boiling liquids, (b) lowering the temperature, pressure, or both, of the mixture to form an aqueous phase and an organic phase, and (c) separating the organic phase from the aqueous phase and recovering the lower boiling liquids from the organic phase.

27. The process of claim 26 wherein the medium contains a hydrogen halide.

28. The process of claim 26 wherein the 1-olefin is ethylene.

29. The process of claim 26 wherein the heavy hydrocarbon oil is shale oil or a crude oil distillation residue.

30. The process of claim 26 wherein step (a) is conducted in a reducing atmosphere.

31. The process of claim 26 wherein the weight ratio of olefin to heavy hydrocarbon oil is from about 0.001:1 to about 0.1:1.

32. The process of claim 26 wherein the heavy hydrocarbon oil feedstocks are substantially free of carbon-carbon unsaturation.

* * * * *